US007493935B2

(12) United States Patent
Nomura et al.

(10) Patent No.: US 7,493,935 B2
(45) Date of Patent: Feb. 24, 2009

(54) CYLINDER DEVICE FOR SCREW CORE REMOVAL

(75) Inventors: Takahide Nomura, Tokyo (JP); Ke Son, Tokyo (JP)

(73) Assignee: Nambu Co., Ltd, Tokyo (JP)

( * ) Notice: Subject to any disclaimer, the term of this patent is extended or adjusted under 35 U.S.C. 154(b) by 91 days.

(21) Appl. No.: 11/764,934

(22) Filed: Jun. 19, 2007

(65) Prior Publication Data

US 2007/0295472 A1 Dec. 27, 2007

(30) Foreign Application Priority Data

Jun. 23, 2006 (JP) ..... 2006-173313

(51) Int. Cl.
*B22D 29/00* (2006.01)
*B22D 33/04* (2006.01)

(52) U.S. Cl. ..... 164/340; 164/132; 164/345; 425/577

(58) Field of Classification Search ..... 164/132, 164/340, 345; 425/577
See application file for complete search history.

(56) References Cited

U.S. PATENT DOCUMENTS 7,146,900 B1 * 12/2006 Matsumoto et al. ..... 91/170 R

* cited by examiner

*Primary Examiner*—Kuang Lin
(74) *Attorney, Agent, or Firm*—Sughrue Mion, PLLC

(57) ABSTRACT

In a cylinder device of the present invention, based on a screwing relationship between a screw rod 30 and a ball screw mechanism 35 and through oil supply port control, the piston and sleeve 15 is made to advance or retract while being rotated. A rear end side of a rod 12 is fitted into a sleeve portion 34 of the piston and sleeve 15. Then, a fitting and coupling mechanism that uses an engagement key 41 and a key groove 42 causes only a rotation torque of the piston and sleeve 15 to act on the rod 12. The rod 12 with a screw core 22 coupled thereto operates at a pitch defined by a screwing relationship between the rod 12 and a rod cover 13. The pitch defined by the screwing relationship is the same as a pitch of the screw core 22.

2 Claims, 7 Drawing Sheets

CYLINDER DEVICE FOR SCREW CORE REMOVAL

BACKGROUND OF THE INVENTION

1. Field of the Invention

The present invention relates to a cylinder device used for inserting or removing a core during die casting and plastic injection molding. More specifically, the invention relates to a cylinder device used when the core for forming a screw hole in a product is inserted or removed.

2. Description of the Related Art

Traditionally, in order to obtain a diecast product with a hole formed therein, a core pin is attached to a die by insertion, and when molten metal poured into a cavity formed by mold clamping has been solidified, the core pin is withdrawn, thereby forming the hole.

In this case, the molten metal is solidified after having been cooled and contracted. Consequently, when the core pin is withdrawn, galling or seizure between the core pin and the product tends to occur.

It has therefore become a common practice to provide a draft angle on the core pin in advance, thereby facilitating detachment of the core pin from the solidified molten metal. Generation of a defective product is thereby prevented.

Japanese Utility Model Unexamined Publication SHO61-167255 discloses a device that withdraws a core pin while rotating the core pin in order to reduce a force for withdrawing the core pin. Further, the applicant of the present invention proposes in Japanese Patent Unexamined Publication H10-131913 and Japanese Patent Unexamined Publication H11-62907 cylinder devices having a function of causing the core pin to perform the operation as described above.

A cylinder device disclosed in Japanese Patent Unexamined Publication H10-131913 has a configuration shown in FIG. 7.

This cylinder device has a basic structure of a single cylinder rod. A screw rod 55 is installed upright and fixed at a position on an inner wall surface of a head cover 51 on a side of a cylinder chamber 52, which faces an axial center 54 of a piston and rod 53. A male screw having a large lead angle is formed in an outer peripheral surface of the screw rod 55. The screw rod 55 has a stroke length longer than that of the piston rod 53.

On the other hand, a screwing board 57 is fixed to a rear end surface of a piston 56 of the piston and rod 53. In the screwing plate 57, a screw hole to be screwed together with the screw rod 55 is formed.

An axial hole 58 is formed in the piston and rod 53. The axial hole 58 extends from the rear end surface of the piston 56 along the axis center. The axial hole 58 has an inner diameter larger than a thread diameter of the screw rod 55, and deeper than a length obtained by subtracting the thickness of the screwing board 57 from the length of the screw rod 55.

When a port 61 that leads to a cylinder chamber 60 on a side of a rod cover 59 is connected to a drain and pressure oil is supplied through a port 62 that leads to the cylinder chamber 52 on a side of the head cover 51 in this configuration, the piston and rod 53 advances while rotating, due to a screwing relationship between the screw rod 55 and the screwing board 57. Conversely, when the port 62 is connected to the drain and the pressure oil is supplied through the port 61, the piston and rod 53 retracts while rotating in a direction opposite to the direction in which the piston and rod 53 advances.

Next, a cylinder device disclosed in Japanese Patent Unexamined Publication HEI11-62907 has a configuration shown in FIG. 8.

In this cylinder device, a pivotally supporting mechanism 73 which pivotally and rotatably supports one end of a rotary rod 72 while restraining movement of the rotary rod 72 in an axial direction is provided at a head cover 71 of a cylinder main body 70 of a two-port type.

The one end of the rotary rod 72 is pivotally supported by the pivotally supporting mechanism 73, and the other end of the rotary rod 72 is protruded, passing through a rod cover 74 of the cylinder main body 70. Further, a male screw 75 having a lead angle of 60 degrees or more is formed on an outer peripheral surface of a portion of the rotary rod 72 positioned within the cylinder main body 70.

A piston 76 fits over the rotary rod 72. The piston 76 thereby can slide within a cylinder tube 77, being in contact with the cylinder tube 77. A portion in which the piston 76 fits over the rotary rod 72 is constituted from a segment in which the piston 76 screws together with the male screw 75 of the rotary rod 72, a section in which the piston 76 fits over a round rod portion of the rotary rod 72, and a non-contact section interposed between the section where the piston 76 screws together with the rotary rod 72 and the section where the piston 76 fits over the round rod portion of the rotary rod 72. Inside the piston 76, a communicating hole 79 is formed. The communicating hole 79 communicates an inside of the non-contact section with a cylinder chamber 78 formed on a side of the section in which the piston 76 screws together with the male screw 75 of the rotary rod 72.

On the other hand, between the piston 76 and the cylinder main body 70, a rotation restraining mechanism that restrains relative rotation is formed. The rotation restraining mechanism is formed of a key 80 installed on an outer periphery of the piston 76 and a key groove 81 formed in an inner periphery surface of the cylinder tube 77 in FIG. 8.

When a port 83 that leads to a cylinder chamber 82 on a side of the rod cover 74 is connected to a drain and pressure oil is supplied through a port 84 that leads to the cylinder chamber 78 on a side of the head cover 71 in this configuration, the rotary rod 72 rotates in one direction with advancement of the piston 76, based on a screwing relationship between the male screw 75 of the rotary rod 72 and the piston 76 and the rotation restraining mechanism formed of the key 80 and the key groove 81. Conversely, when the port 84 is connected to the drain and the pressure oil is supplied through the port 83, the rotary rod 72 rotates in a direction opposite to the direction in which the rotary rod rotates with advancement of the piston 76, with retraction of the piston 76.

Round holes are formed in a product resulting from die casting or plastic injection molding using a core pin. Depending on the product, all or part of the round holes after molding must be sometimes formed into screw holes. In such a case, an additional process will be provided separately to process the round holes into the screw holes.

Accordingly, when a screw hole is included in a final product, the additional process must be incorporated, without exception. Further, since orientations of the screw holes for the product are not limited to one direction in general, automation of the process for obtaining the screw holes is often difficult. Thus, an increase in manufacturing cost may be inevitably brought about.

In order to cope with the problem described above, the following method can be conceived. As a core pin, a core having a required male screw (hereinafter referred to as a "screw core") is used. Then, in the case of a diecast product, the screw core is inserted into molten metal, and when the molten metal is solidified, the screw core is retracted just by the number of pitches of the male screw for each rotation, for removal. Then, a resulting hole after the removal of the screw core can be formed into the shape of the required male screw.

The cylinder device (shown in FIG. 7) disclosed in Japanese Patent Unexamined Publication H10-131913 can cause the piston and rod 53 to retract while rotating the piston rod 53 by a large torque. Accordingly, it seems that the cylinder device can be employed for screw hole formation, in principle.

However, in this cylinder device, the piston and rod 53 is rotated, using the screwing relationship between the screw rod 55 and the screwing board 57. Thus, lead angles of respective screw portions of the screw rod 55 and the screwing board 57 are obliged to be set to be far larger than the lead angle of an ordinary screw. Accordingly, in terms of both a rotation pitch and a stroke length, the cylinder device shown in FIG. 7 cannot be applied as the cylinder device for removing the screw core.

SUMMARY OF THE INVENTION

An object of the present invention is to provide a cylinder device that can cause a screw core to advance or retract at a screw pitch thereof while being strongly rotated during a process of die casting or plastic injection molding, thereby allowing a product with a screw hole formed therein to be directly obtained during the die casting or plastic injection molding.

A cylinder device for screw core removal according to the present invention has an outward appearance as a single-rod type double-acting cylinder.

In a cylinder tube of the cylinder device, an inside diameter of the cylinder tube in a stroke segment of a piston portion of a piston and sleeve that will be described later is formed so that the piston portion is fit into the cylinder tube and slid in contact with the cylinder tube. An inside diameter of the cylinder tube in a given segment in front of the stroke segment is formed so that a sleeve portion of the piston and sleeve is fit into the cylinder tube and slid in contact with the cylinder tube.

In a leading end portion of a rod of the cylinder device, a screw core is installed consecutively and coaxially. The rod has a male screw segment with a male screw formed therein in a location of the rod separated from the screw core by a predetermined distance. The male screw segment has a same pitch as a screw pitch of the screw core. A rear-end-side segment of the rod is formed as an internal fitting portion for the sleeve portion of the piston and sleeve. An axial hole is formed in the rod from a rear-end surface of the internal fitting portion to a front position of the male screw segment. A first communicating hole and a second communicating hole are formed in the rod. The first communicating hole communicates the axial hole with the front position of the male screw segment. The second communicating hole communicates the axial hole with a location of the internal fitting portion over which the sleeve portion of the piston and sleeve does not fit in close contact with the internal fitting portion.

In a rod cover of the cylinder device, a female hole is formed. The female hole screws together with the male screw segment of the rod and causes the rod to penetrate the rod cover in a screwed state.

A screw rod is installed upright and fixed to an inner wall surface of a head cover of the cylinder on a cylinder chamber side. An axial center of the screw rod is directed in an axial center direction of the rod screwed together with the rod cover.

A piston and sleeve of the cylinder device is constituted from a piston portion and a sleeve portion each having a hollow cylindrical shape and being fit into the cylinder tube. The sleeve portion is installed coaxially and consecutively with the piston portion. A screw mechanism is installed inside the piston and sleeve on an inner peripheral side of the piston portion. The screw mechanism screws together with the screw rod installed upright and fixed to the head cover. Further, the sleeve portion fits over the rear-end-side segment of the rod.

The cylinder device includes a mechanism for fitting the rear-end-side segment of the rod into the sleeve portion of the piston and sleeve and coupling the rear-end-side segment of the rod to the sleeve portion of the piston and sleeve. In the fitting and coupling mechanism, the rear-end-side segment of the rod and the sleeve portion of the piston and sleeve forms a sliding pair in an axial direction of the cylinder device, and the rear-end-side segment and the sleeve portion is engaged with each other in a peripheral direction of the cylinder device.

The cylinder device further includes an oil supply port at a location thereof capable of supplying operating oil to a cylinder chamber in front of the piston portion when the piston portion is in a forward limit position within the cylinder tube, and an oil supply port at a location thereof capable of supplying the operating oil to a cylinder chamber to the rear of the piston portion when the piston portion is in a backward limit position within the cylinder tube.

According to the present invention, when the piston and sleeve advances or retracts in the axial direction, a rotation torque acts on the piston and sleeve due to a screwing relationship between the screw rod and the ball screw mechanism. The piston and sleeve therefore rotates while advancing or retracting in the axial direction.

Then, the fitting and coupling mechanism between the sleeve portion of the piston and sleeve and the internal fitting portion of the rod serves to transmit only the rotation torque of the piston and sleeve to the rod. The rod is thereby rotated by the strong rotation torque.

On the other hand, the rod with the screw core installed consecutively at a leading end thereof operates according to a pitch defined by the screwing relationship between the rod and the rod cover. The pitch of the rod with the screw core is the same as the pitch of the screw core.

Accordingly, the screw core advances or retracts by the screw pitch thereof for each rotation, due to the strong rotation torque supplied from the piston and sleeve.

The reason why the ball screw mechanism is used is to obtain the great number of rotations in a short stroke. When the piston and sleeve and the screw rod are directly screwed together as in the cylinder device disclosed in Japanese Patent Unexamined Publication H10-131913, a large lead angle must be set. Accordingly, in order to obtain the required number of rotations, an impractically very long stroke is required.

In the present invention, the cylinder tube is divided into a stroke segment of the piston portion and a fitting segment between the internal fitting portion of the rod and the sleeve portion. The stroke segment of the piston portion is the same as in a structure of an ordinary double-acting cylinder. Due to a screwing relationship in which the rod screws together with the rod cover and a fitting relationship between the internal fitting portion of the rod and sleeve portion, a gap is formed in front of a screwing portion between and rod and the rod cover, and a chamber is formed between the rod cover and a front end of the sleeve portion.

Then, volumetric capacities of these gap and chamber are expanded or contracted according to movements of the piston and sleeve and the rod. Thus, when no measures are taken against the expansion or contraction of the volumetric capacities, a load pressure is generated, so that the piston and sleeve and the rod cannot be operated.

Then, the present invention uses the screwing relationship between the screw rod and the ball screw mechanism in which the screw rod is communicated to the sleeve portion, thereby circulating the operating oil. The cylinder chamber on a rear side of the piston portion is communicated to the sleeve portion. Further, through the axial hole of the rod and the first and second communicating holes, an inside of the sleeve portion is communicated to the gap formed in front of the screwing portion between the rod and the rod cover and the chamber formed between the front end of the sleeve portion and the rod cover.

Accordingly, even if the volumetric capacities of the gap and the chambers are expanded or contracted due to movements of the piston and sleeve and the rod, pressure oil corresponding to a change caused by the expansion or contraction is supplied or discharged through the oil supply port on a side of the cylinder chamber on the rear side. Thus, the load pressure will not be generated.

In other words, using the ball screw mechanism, the present invention makes it possible to obtain the great number of rotations in a short stroke (or to reduce a full length of a cylinder). At the same time, using the communication state of the ball screw mechanism, a rotating function of the screw core is rationally achieved by a single cylinder device.

As a specific configuration of the fitting and coupling mechanism, the fitting and coupling mechanism may include an engagement key and a key groove, for example. Then, the engagement key may be fixed to a concave portion formed in an outer peripheral surface of the rear-end-side segment of the rod, and a key groove, with which the engagement key is engaged and slides in contact with the key groove in a direction parallel to an axis of the cylinder device, may be formed in an inner peripheral surface of the sleeve portion of the piston and sleeve. In this case, the second communicating hole of the rod can be formed in a location in front of the engagement key in the axial direction.

The various features of novelty which characterize the invention are pointed out with particularity in the claims annexed to and forming a part of this specification. For a better understanding of the invention, its operating advantages, and specific objects attained by its use, reference should be had to the accompanying drawing and descriptive matter in which there is illustrated and described a preferred embodiment of the invention.

DETAILED DESCRIPTION OF THE PREFERRED EMBODIMENT

Figure 1:
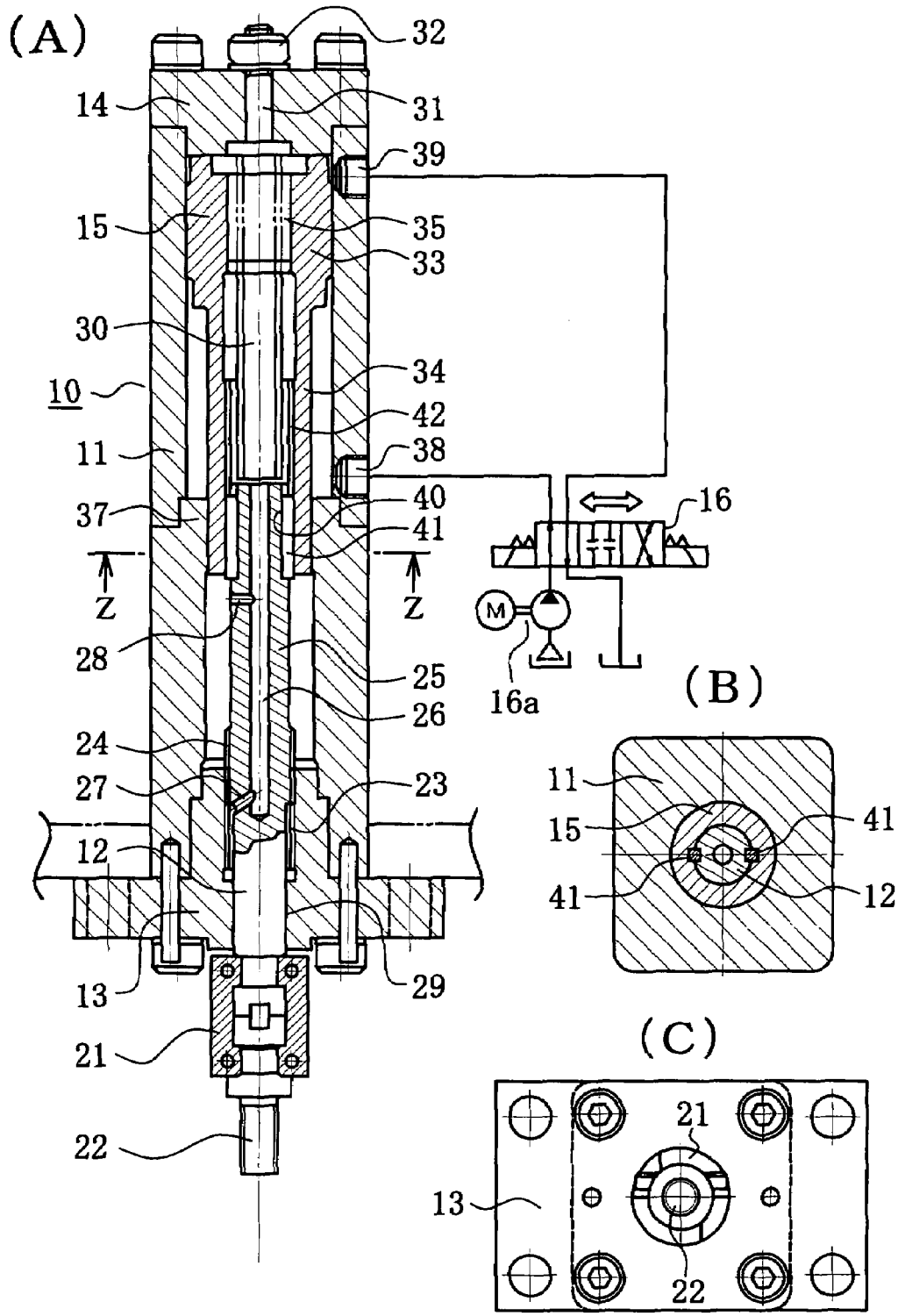
FIG. 1(A) is a sectional view of a cylinder device for screw core removal and a driving hydraulic circuit diagram.
FIG. 1(B) is an auxiliary sectional view seen taken in the direction of arrows Z-Z of FIG. 1(A)
FIG. 1(C) is a front view of the cylinder device.

A cylinder device for screw core removal according to an embodiment of the present invention will be described below in detail, based on FIGS. 1 to 6.

First, FIG. 1(A) is a sectional view of the cylinder device and a driving hydraulic circuit diagram. FIG. 1(B) is an auxiliary sectional view seen taken in the direction of arrows Z-Z of FIG. 1(A). FIG. 1(C) is a front view of the cylinder device. This cylinder device 10 has an outward appearance as a single-rod type double-acting cylinder.

Referring to each of the drawings, the cylinder device in the embodiment of the present invention includes a cylinder tube 11, a rod 12, a rod cover 13, a head cover 14, a piston and sleeve 15, a four-port three-position switching valve 16, and a hydraulic pump 16*a*. Sealing members are provided at a sliding portion of a piston and junction portions between respective members of the cylinder device 10, respectively, as necessary. In FIG. 1(A), however, notation of these sealing members is omitted.

A screw core 22 is coaxially coupled to a leading end of the rod 12 through a coupler 21. A male screw segment 24 is formed on a portion that penetrates the rod cover 13. The male screw segment 24 screws together with a female screw 23 formed on a side of the rod cover 13. A portion to the rear of the male screw segment 24 is formed as an internal fitting portion 25 for a sleeve portion 34 of the piston and sleeve 15. The internal fitting portion extends to a substantial center of the cylinder tube 11.

In the rod 12, a axial hole 26 is formed from a rear end surface of the rod 12 to a front position of the male screw segment 24, a communicating hole 27 that communicates the axial hole 26 with an outer periphery of the rod 12 in the front position of the male screw segment 24, and a communicating hole 28 that communicates the axial hole 26 with an outer periphery of the rod 12 to the rear of the male screw segment 24 is formed. The screw core 22 in this embodiment has a whole length of 30 mm and has a screw pitch of 1.5 mm.

The rod cover 13 is different from an ordinary double-acting cylinder. In the rod cover 13, the female screw 23 is formed in a portion of an opening 29 through which the rod 12 penetrates, and the rod 12 penetrates the rod cover 13 in a state where the rod 12 is screwed together with the female screw 23.

Then, a male screw on the side of the rod 12 and the female screw on the side of the rod cover 13 have the same screw pitch as the screw pitch of the screw core 22. The screw core 22 advances or retracts just by a distance corresponding to the screw pitch, by one clockwise or counterclockwise rotation of the rod 12.

Accordingly, in order to move the screw core 22 of the whole length 30 mm (with the screw pitch of 1.5 mm) in an axis direction of the cylinder device, it is necessary to cause the rod 12 to make 20 rotations. Incidentally, the screw core 22 is used when a screw hole of an ordinary right screw is formed. When a screw hole of an opposite screw (left screw) is formed, the male screw on the side of the rod 12 and the female screw on the side of the rod cover 13 have shapes associated with formation of the screw hole of the opposite screw, respectively.

The head cover 14 is not an ordinary cover end plate. A screw rod 30 is installed upright and fixed to the head cover 14 so that the axial center of the screw rod 30 is directed in an axial center direction of the rod 12 which screws together with the rod cover 13.

In this embodiment, an extension rod portion 31 is provided at a rear end of the screw rod 30. Then, the extension rod portion 31 is passed through the head cover 14, and is attached to a back surface side of the head cover 14 by tightening of a nut 32. The screw rod 30 may also be welded and installed upright and fixed to the head cover 14.

The piston and sleeve 15 is constituted from a piston portion 33 and the sleeve portion 34 each having a hollow cylindrical shape. The piston portion 33 and the sleeve portion 34 are coaxially formed to be integral with each other.

Then, a ball screw mechanism 35 that screws together with the screw rod 30 on a side of the head cover 14 is installed inside the piston portion 33. The ball screw mechanism is installed on an inner peripheral side of the piston portion 33, and causes the screw rod 30 to penetrate the sleeve portion 34. The sleeve portion 34 fits over the internal fitting portion 25 of the rod 12 that is inserted into the sleeve portion 34 from a front end of the sleeve portion 34.

Figure 2:
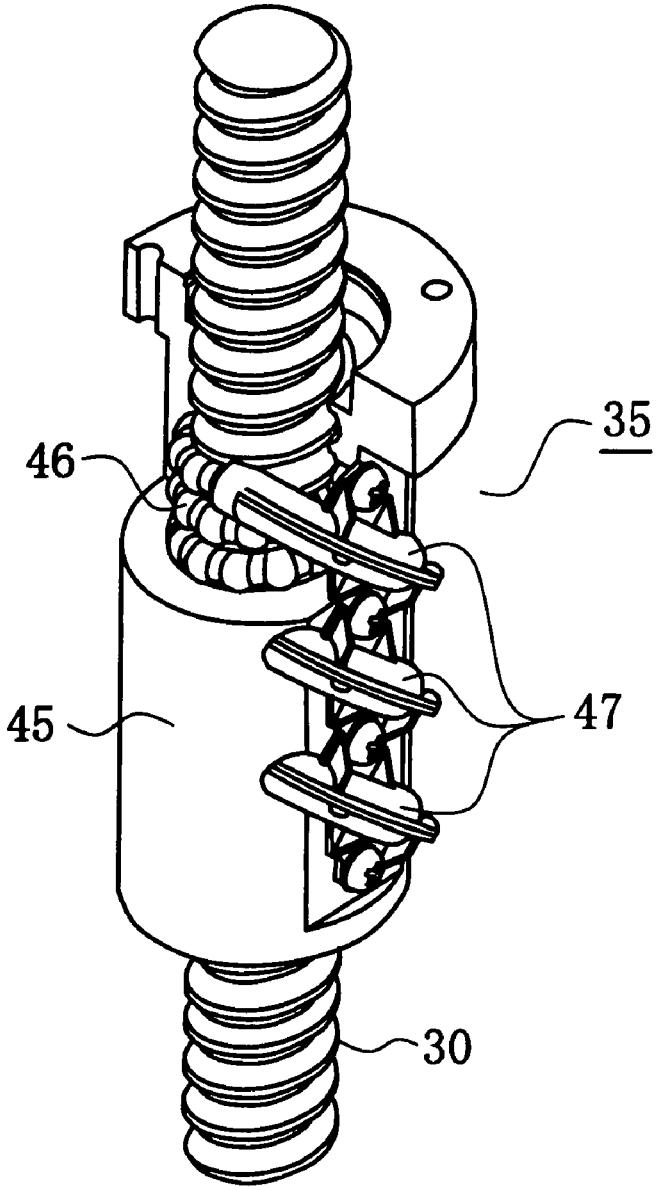
FIG. 2 is a (partially broken) perspective view of a ball screw mechanism.
Figure 3:
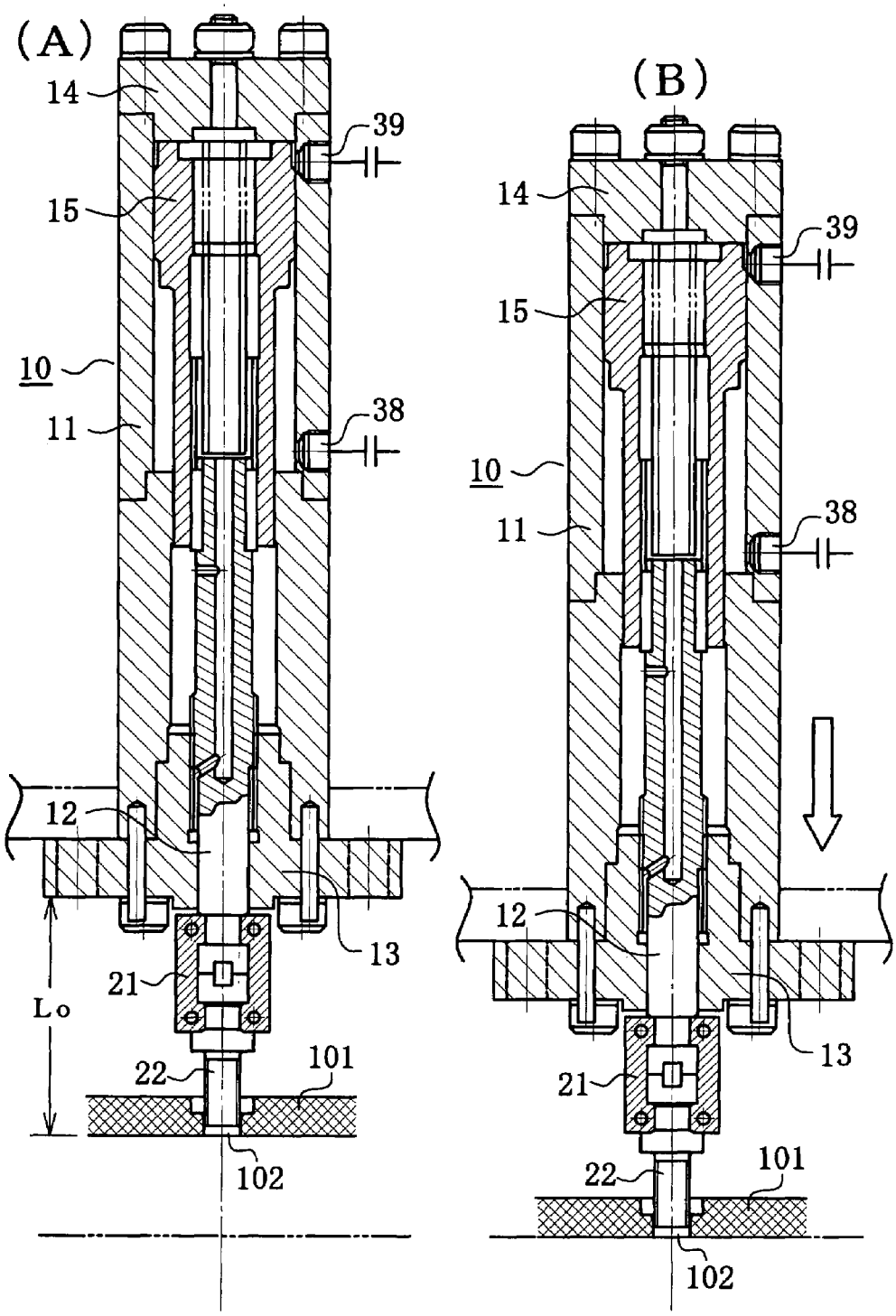
FIG. 3(A) is a sectional view showing an operating state of the cylinder device.
FIG. 3(B) is a sectional view showing an operating state of the cylinder device.
Figure 4:
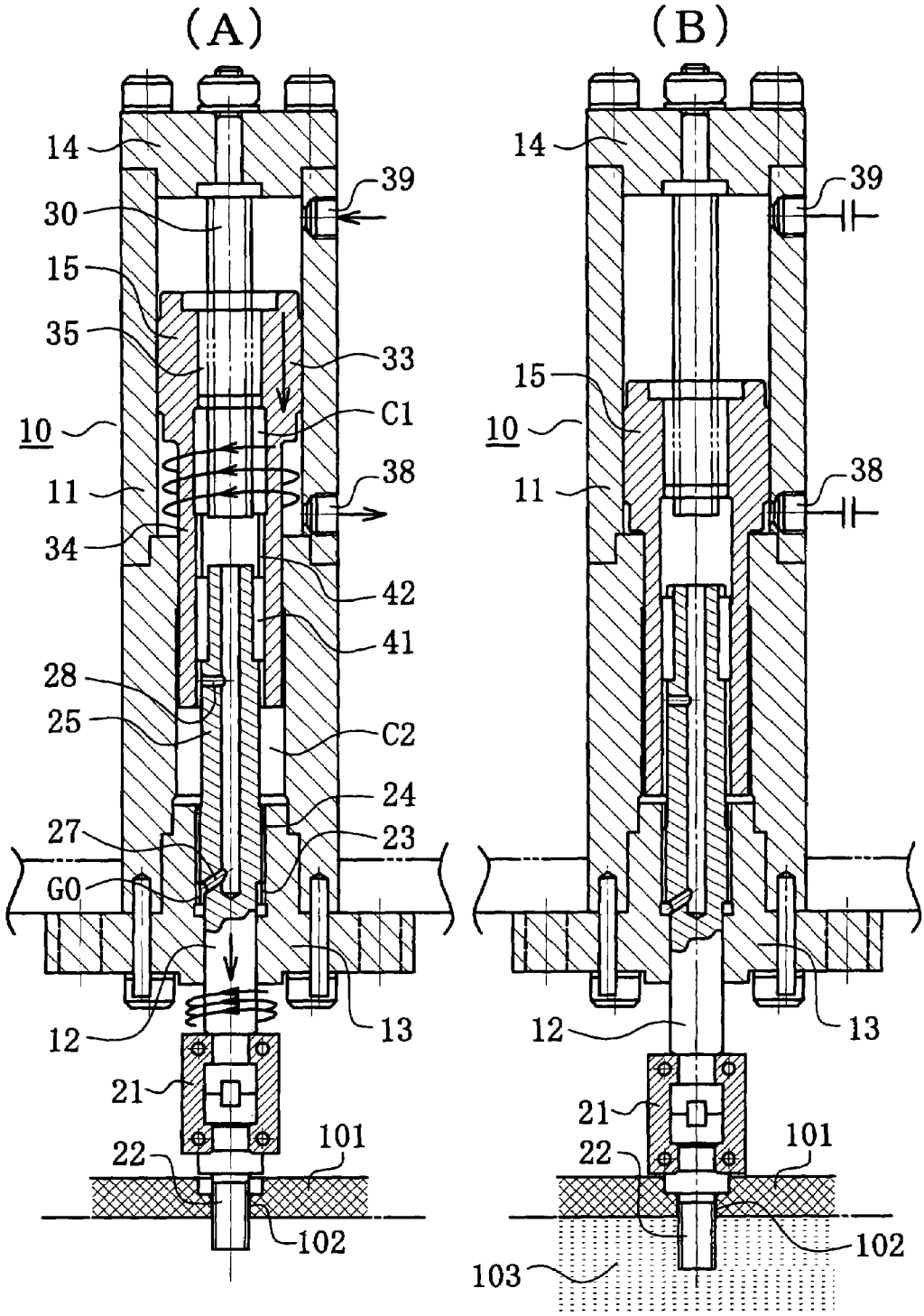
FIG. 4(A) is a sectional view showing an operating state of the cylinder device.
FIG. 4(B) is a sectional view showing an operating state of the cylinder device.
Figure 5:
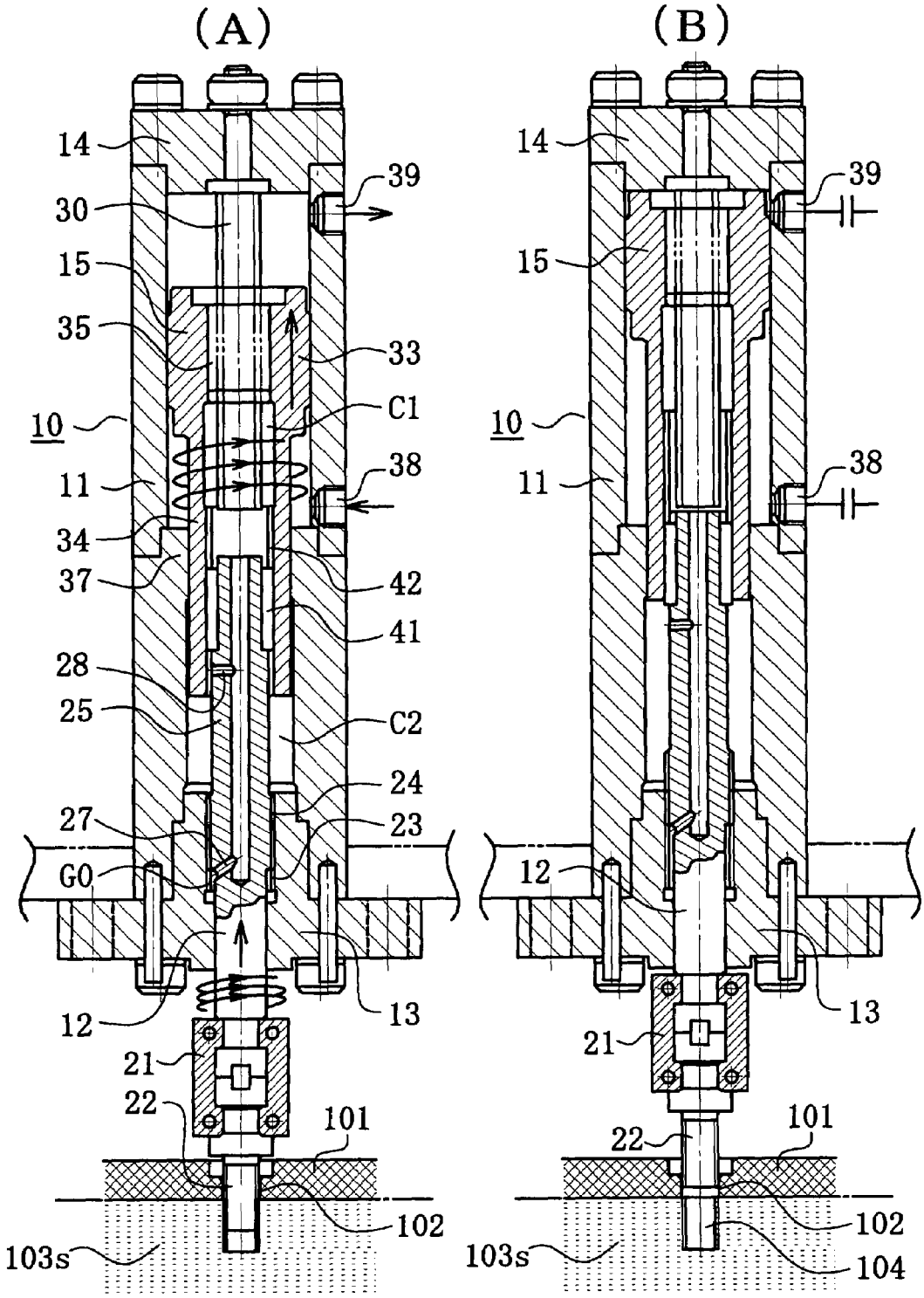
FIG. 5(A) is a sectional view showing an operating state of the cylinder device.
FIG. 5(B) is a sectional view showing an operating state of the cylinder device.

The ball screw mechanism 35 has a configuration as shown in FIG. 2, for example.

Specifically, a screw groove corresponding to a thread of the screw rod 30 is formed in an inner peripheral surface of a cylindrical nut 45. Balls 46 roll through a spiral passage formed by a screw groove of the screw rod 30 and the screw groove of the nut 45 opposed to each other, respectively, as a load. The nut 45 thereby linearly moves relative to the screw rod 30. Tubes (return passages) 47 are disposed to couple starting and ending points of the spiral passage at given intervals, respectively, thereby forming a circulation path for the balls 46.

A pitch associated with a screwing relationship between the ball screw mechanism 35 and the screw rod 30 in this embodiment is determined by a relationship between a stroke length of the piston and sleeve 15 and the required number (20) of rotations of the screw core 22 (rod 12). When the stroke length is set to 80 mm, the pitch is set to 4 mm (=80/20).

Each of front and rear end portions of the piston portion 33 has an outside diameter which is a little smaller than an outside diameter of other portion of the piston portion 33 to ensure inflow and outflow of pressure oil at forward and backward limits of the piston portion 33.

An inside diameter of the cylinder tube 11 in a stroke segment of the piston portion 33 in the piston and sleeve 15 is different from inside diameters of the cylinder tube 11 in a segment located in front of the stroke segment. To be more specific, the inside diameter of the cylinder tube in the stroke segment of the piston portion 33 is naturally set to the one that causes the piston portion 33 to be fit into the cylinder tube 11 and slid in contact with the cylinder tube 11. An inside diameter of the cylinder tube in a given segment in front of the stroke segment is set to the one that causes the sleeve portion 34 of the piston and sleeve 15 to be fit into the cylinder tube 11 and slid in contact with the cylinder tube 11. Further, an inside diameter of a segment that is located in front of the given segment and that reaches an inner wall of the rod cover 13 is set to be slightly larger than the inside diameter of the given segment.

The given segment of the cylinder tube 11 is a partition wall 37 that divides the tube into front and rear portions, which also achieves a function of supporting the sliding movement of the sleeve portion 34 of the piston and sleeve 15.

Then, oil supply ports 38 and 39 are formed in the cylinder tube 11 in positions corresponding to front and rear ends of the stroke segment of the piston portion 33, respectively. A supply and discharge hydraulic circuit that uses the four-port three-position switching valve 16 is connected to the oil supply ports 38 and 39.

A relationship between the internal fitting portion 25 on a rear side of the rod 12 and the sleeve portion 34 of the piston and sleeve 15 is not just a fitting relationship. The internal fitting portion 25 and the sleeve portion 34 constitute a fitting and coupling mechanism in which the internal fitting portion 25 and the sleeve portion 34 form a sliding pair in an axial direction of the cylinder device, while the internal fitting portion 25 and the sleeve portion 34 are engaged with each other in a peripheral direction of the cylinder device.

In this embodiment, an engagement key 41 is fixed to a concave portion 40 formed in an outer peripheral surface of a rear-end-side segment of the rod 12, and a key groove 42 is formed in an inner peripheral surface of the sleeve portion 34 of the piston and sleeve 15. The engagement key 41 is fit into the key groove 42 and slides in contact with the key groove 42 in a direction parallel to an axis of the cylinder device. With this arrangement, a function of causing only a rotation torque of the piston and sleeve 15 to act on the rod 12, and not causing a driving force in the axial direction to act on the rod 12 is achieved.

Accordingly, when the piston and sleeve 15 moves from a backward limit thereof to a forward limit thereof (travels 80 mm), the piston and sleeve 15 and the rod 12 make 20 clockwise rotations. The rod 12 and the screw core 22 also make 20 rotations, thereby advancing just by 30 mm. Conversely, when the piston and sleeve 15 moves from the forward limit thereof to the backward limit thereof, the piston and sleeve 15 and the rod 12 make 20 counter-clockwise rotations. The rod 12 and the screw core 22 also make 20 rotations likewise, thereby retracting just by 30 mm.

The communicating hole 28 is formed in a position in front of the fixed position of the engagement key 41 in the rod 12 in the axis direction. With this arrangement, even if the communicating hole 28 is covered with the sleeve portion 34 of the piston and sleeve 15, an inside of the sleeve portion 34 can be always communicated to a chamber formed in front of the sleeve portion 34 through the key groove 42.

The cylinder device 10 for screw core removal having a configuration and functions described above is incorporated into a movable-type die for die casting, and operates as follows.

First, FIG. 3(A) shows a relationship between the cylinder device 10 and a movable-type die 101 when the movable die 101 is opened. The cylinder device 10 is fixed in a position separated from a bottom surface of the movable die 101 by a distance Lo.

Then, in this state, the piston and sleeve 15 and the rod 12 are both positioned at their respective backward limits, and the four-port three-position switching valve 16 causes both of the oil supply ports 38 and 39 to be closed. When the piston and sleeve 15 and the rod 12 are at their respective backward limits, a positional relationship between the cylinder device 10 and the movable die 101 is set so that a leading end of the screw core 202 is fit halfway into an opening 102 of the movable die 101.

A chain double-dashed line in the bottom of FIG. 3(A) corresponds to a position of the bottom surface of the movable die 101 (that becomes a cavity inner wall of the die) when the die is clamped.

Next, the movable die 101 and the cylinder device 10 are moved downward by a driving device not shown, and the die is clamped, as shown in FIG. 3(B). Even in this stage, however, the oil supply ports 38 and 39 are still closed, and the piston and sleeve 15 and the rod 12 remain at their respective backward limits.

When die clamping is performed, the four-port three-position switching valve 16 is switched so that the oil supply port 38 is connected to a drain and the oil supply port 39 is connected to the hydraulic pump 16*a*.

In this state, a pressure in a cylinder chamber on a side of the head cover 14 of the piston and sleeve 15 is increased, so that the piston and sleeve 15 is driven forward (downward). Due to the screwing relationship between the screw rod 30 installed upright and fixed to the head cover 14 and the ball screw mechanism 35 installed inside the piston portion 33, the piston and sleeve 15 advances at a pitch of 4 mm while rotating in a clockwise direction, as shown in FIG. 4(A).

Then, since the sleeve portion 34 of the piston and sleeve 15 and the internal fitting portion 25 of the rod 12 constitute the fitting and coupling mechanism that uses the engagement key 41 and the key groove 42 as described above, only the rotation torque of the piston and sleeve 15 acts on the rod 12, and the rod 12 rotates together with the piston and sleeve 15.

The male segment 24 of the rod 12 screws together with the female screw 23 on the side of the rod cover 13. When the rod 12 is rotated, the rod 12 and the screw core 22 advance at a pitch of 1.5 mm while rotating in the clockwise direction, based on this screwing relationship.

It is natural that volumetric capacities of cylinder chambers in front of and to the rear of the piston portion 33 should change when the piston and sleeve 15 and the rod 12 move in the axial direction. In this cylinder device 10, a volumetric capacity of a chamber C1 formed inside the sleeve portion 34, a volumetric capacity of a chamber C2 that is located in front of the sleeve portion 34 and is formed around the internal fitting portion 25 of the rod 12, and a volumetric capacity of a gap G0 in the rod cover 13 located in front of a screwing portion between the female screw 23 in rod cover 13 and the male screw segment 24 of the rod 12 also change.

Accordingly, when these chambers C1 and C2 and the gap G0 are sealed, movement of the piston and sleeve 15 and the rod 12 in the axial direction will be prevented.

However, in this embodiment, the communicating holes 28 and 27 are formed in the rod 12, and pressure oil circulation paths are formed between the screw rod 30 and the balls 46 of the ball screw mechanism 35 and inside the ball screw mechanism 35, respectively. Thus, the chambers C1 and C2 and the gap G0, the axial hole 26 of the rod 12, the inside of the sleeve portion 34 of the piston and sleeve 15, a rear-side cylinder chamber on the side of the head cover 14, and the oil supply port 39 are always communicated. Consideration is therefore given so that a load will not be generated even if expansion or contraction of the chambers C1, C2, or the gap G0 occurs.

When the piston and sleeve 15 and the rod 12 reach their respective forward limits as described above, the screw core 22 passes through the opening 102 of the movable-type die 101 and is inserted within a cavity of the die. Then, the four-port three-position switching valve 16 is switched at that point to cause both of the oil ports 38 and 39 to be closed.

Then, after molten metal 103 has been injected and charged into the cavity, the cylinder device is kept as it is for a time required for cooling and solidifying the molten metal 103.

When the molten metal 103 is cooled and solidified, transition to a removal process of the screw core 22 is made. Then, the four-port three-position switching valve 16 is switched so that the oil supply port 39 is connected to the drain and the oil supply port 38 is connected to the hydraulic pump 16*a*.

A state of the cylinder device 10 in the removal process of the screw core 22 is shown in FIG. 5(A). Basically, the state of the cylinder device is reverse to the state of the cylinder device in the insertion process of the screw core 22 in FIG. 4(A).

More specifically, a pressure in the cylinder chamber on a side of the partition wall 37 for the piston and sleeve 15 are increased, so that the piston and sleeve 15 is driven backward (upward). Due to the screwing relationship between the screw rod 30 installed upright and fixed to the head cover 14 and the ball screw mechanism 35 fixed to the piston portion 33, the piston and sleeve 15 retracts at a pitch of 4 mm while rotating in a counterclockwise direction.

Then, due to the fitting and coupling mechanism constituted from the sleeve portion 34 of the piston and sleeve 15 and the internal fitting portion 25 of the rod 12, which uses the engagement key 41 and the key groove 42, only the rotation torque of the piston and sleeve 15 acts on the rod 12. Further, based on the screwing relationship between the male screw segment 24 of the rod 12 and the female screw 23 on the side of the rod cover 13, the rod 12 and the screw core 22 retract at a pitch of 1.5 mm while rotating in the counterclockwise direction.

In this case as well, the communicating holes 27 and 28 are formed, and the pressure oil circulation paths are formed between the screw rod 30 and the balls 46 of the ball screw mechanism 35, and inside the ball screw mechanism 35, as in the case of FIG. 4(A) described before. Accordingly, even if expansion or contraction of the chamber C1, C2, or the gap G0 occurs, no load will not be generated.

A magnitude of the torque required for rotation of the rod 12 in this removal process of the screw core 22 becomes a far larger than in the case of the insertion process of the screw core 22 (shown in FIGS. 4(A) and 4(B)).

The reason for this phenomenon is as follows. A load torque on a side of the rod 12 when the insertion process of the screw core is performed occurs just at the screwing portion between the male screw segment 24 of the rod 12 and the female screw 23 on the side of the rod cover 13. In the removal process of the screw core, a rotation torque for spirally removing the screw core 22 embedded into a cast metal 103*s* resulting from cooling and solidification of the molten metal 103 becomes necessary. For this reason, a powerful rotation torque needs to be supplied in the removal process of the screw core.

In the cylinder device 10 in this embodiment, however, a hydraulic driving force for the piston and sleeve 15 is converted to a rotation force, and a spiral operation is thereby performed. Accordingly, the required rotation torque can be supplied sufficiently.

Then, the piston and sleeve 15 and the rod 12 are moved back to their respective backward limits, as shown in FIG. 5(B). Thereafter, the four-port three-position switching valve 16 is switched so that each of the oil supply ports 38 and 39 is closed.

In this stage, the screw core 22 is removed from the cast metal 103*s*, and a screw hole 104 corresponding to the screw core 22 is formed in the cast metal 103*s*.

Figure 6:
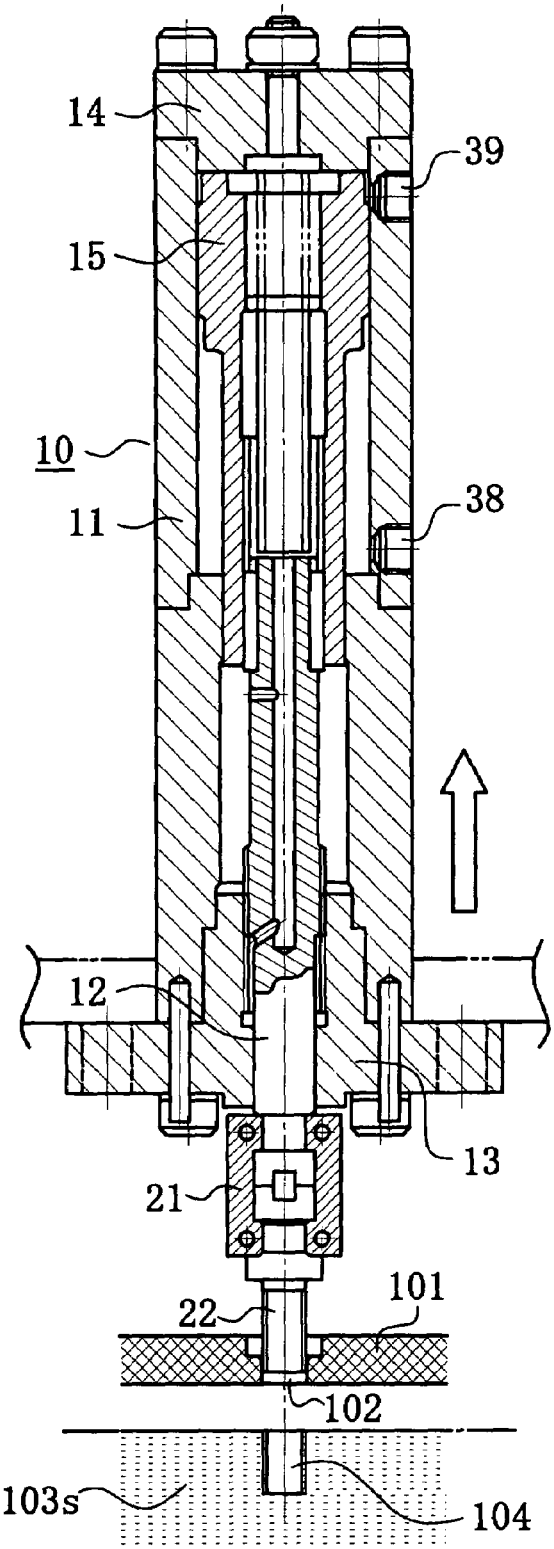
FIG. 6 is a sectional view showing an operating state of the cylinder device.
Figure 7:
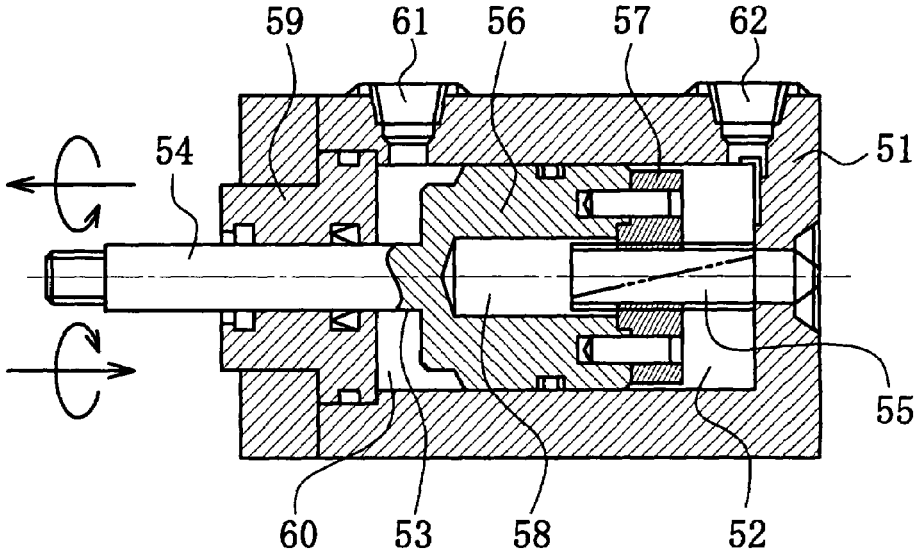
Fig. 7 ( Prior Art )
FIG. 7 is a sectional view of a cylinder device for core pin removal according to a prior art, disclosed in Japanese Patent Unexamined Publication H10-131913.
Figure 8:
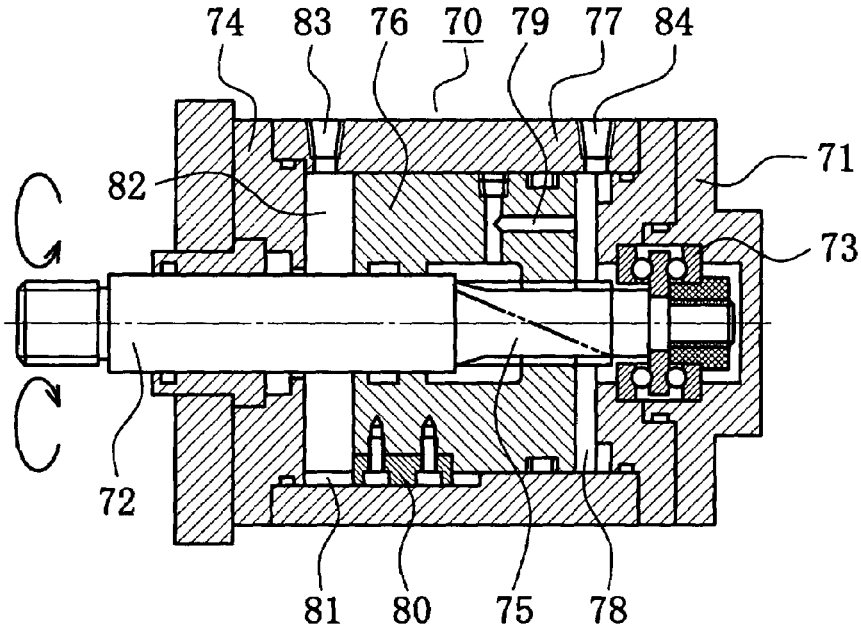
Fig. 8 ( Prior Art )
FIG. 8 is a sectional view of a cylinder device for core pin removal according to a prior art, disclosed in Japanese Patent Unexamined Publication H11-62907.

Finally, the movable die 101 and the cylinder device 10 are moved upward by the driving device not shown, as shown in FIG. 6. Then, the die is opened, and a product formed of the cast metal 103*s* is extracted from a fixed die (not shown).

In this embodiment, the core screw 22 is coaxially attached to the rod 12, using the coupler 21. A leading edge portion of the rod 12 without alteration may also be formed as the core screw 22.

What is claimed is:

1. A cylinder device for screw core removal having an outward appearance as a single-rod type double-acting cylinder, comprising:

a cylinder tube with an inside diameter thereof in a stroke segment of a piston portion of a piston and sleeve formed so that said piston portion is fit into said cylinder tube and slid in contact with said cylinder tube, and with an inside diameter thereof in a given segment in front of said stroke segment formed so that a sleeve portion of said piston and sleeve is fit into said cylinder tube and slid in contact with said cylinder tube;

a rod including:

a core having a male screw (hereinafter referred to as a "screw core") installed consecutively and coaxially in a leading end portion of said rod, said rod having a male screw segment with a male screw formed therein in a location thereof separated from said screw core by a predetermined distance and a rear-end-side segment formed as an internal fitting portion for said sleeve portion of said piston and sleeve, said male screw segment having a same pitch as a screw pitch of said screw core, said rod having an axial hole formed therein, said axial hole extending from a rear-end surface of said internal fitting portion to a front position of said male screw segment, said rod having a first communicating hole and a second communicating hole formed therein, said first communicating hole communicating said axial hole with the front position of said male screw segment, said second communicating hole communicating said axial hole with a location of said internal fitting portion, said sleeve portion of said piston and sleeve not fitting over said location of said internal fitting portion in close contact with said internal fitting portion;

a rod cover with a female hole formed therein, said female hole screwing together with said male screw segment of said rod and causing said rod to penetrate said rod cover in a screwed state;

a head cover with a screw rod installed upright and fixed to an inner wall surface thereof on a first cylinder chamber side so that an axial center of said screw rod is directed in an axial center direction of said rod screwed together with said rod cover;

said piston and sleeve comprising said piston portion and said sleeve portion each having a hollow cylindrical shape and being fit into said cylinder tube, said sleeve portion being installed coaxially and consecutively with said piston portion, said piston and sleeve including a screw mechanism installed inside said piston and sleeve on an inner peripheral side of said piston portion, said screw mechanism screwing together with said screw rod installed upright and fixed to said head cover, and said sleeve portion fitting over said rear-end-side segment of said rod; and a fitting and coupling mechanism formed of said rear-end-side segment of said rod and said sleeve portion of said piston and sleeve, said rear-end-side segment and said sleeve portion forming a sliding pair in an axial direction of the cylinder device, and said rear-end-side segment and said sleeve portion being engaged with each other in a peripheral direction of the cylinder device;

the cylinder device further comprising:

an oil supply port at a location thereof capable of supplying operating oil to a second cylinder chamber in front of said piston portion when said piston portion is in a forward limit position within said cylinder tube; and another oil supply port at a location thereof capable of supplying the operating oil to said first cylinder chamber to the rear of said piston portion when said piston portion is in a backward limit position within said cylinder tube.

2. The cylinder device for screw core removal according to claim 1, wherein said fitting and coupling mechanism includes:

an engagement key fixed to a concave portion formed in an outer peripheral surface of said rear-end-side segment of said rod; and a key groove formed in an inner peripheral surface of said sleeve portion of said piston and sleeve, said engagement key being engaged with said key groove and sliding in contact with said key groove in a direction parallel to an axis of the cylinder device;

said second communicating hole of said rod being formed in a location in front of said engagement key in the axial direction.

* * * * *